US008960699B2

(12) United States Patent
Sprigle et al.

(10) Patent No.: US 8,960,699 B2
(45) Date of Patent: Feb. 24, 2015

(54) SUSPENSION SEAT FOR USE ON WHEELCHAIR

(76) Inventors: Stephen H. Sprigle, Marietta, GA (US); Randy Bernard, Auburn, GA (US)

( * ) Notice: Subject to any disclaimer, the term of this patent is extended or adjusted under 35 U.S.C. 154(b) by 0 days.

(21) Appl. No.: 13/821,527

(22) PCT Filed: Sep. 9, 2011

(86) PCT No.: PCT/US2011/050986

§ 371 (c)(1),
(2), (4) Date: Mar. 7, 2013

(87) PCT Pub. No.: WO2012/034009

PCT Pub. Date: Mar. 15, 2012

(65) Prior Publication Data

US 2013/0161923 A1 Jun. 27, 2013

Related U.S. Application Data

(60) Provisional application No. 61/381,607, filed on Sep. 10, 2010.

(51) Int. Cl.

| | |
|---|---|
| ***A61G 5/10*** | (2006.01) |
| ***A47C 7/14*** | (2006.01) |
| ***A61G 5/02*** | (2006.01) |
| *A61G 7/057* | (2006.01) |

(52) U.S. Cl.

CPC ... *A61G 5/10* (2013.01); *A47C 7/14* (2013.01); *A61G 5/02* (2013.01); *A61G 7/05723* (2013.01); *A61G 2005/1091* (2013.01); *A61G 2200/20* (2013.01)

USPC ..... 280/250.1; 297/452.56

(58) Field of Classification Search

USPC ..... 297/452.56, 452.57, 452.13; 280/250.1, 280/304.1

See application file for complete search history.

(56) References Cited

U.S. PATENT DOCUMENTS

| | | | | |
|---|---|---|---|---|
| 4,682,818 | A * | 7/1987 | Morell | 297/452.27 |
| 4,770,432 | A * | 9/1988 | Wagner | 280/250.1 |
| 4,997,154 | A * | 3/1991 | Little | 248/230.5 |
| 5,294,181 | A * | 3/1994 | Rose et al. | 297/452.25 |
| 6,361,117 | B1 * | 3/2002 | Tate | 297/452.56 |
| 6,755,477 | B2 * | 6/2004 | Chow | 297/452.56 |
| 6,938,290 | B2 * | 9/2005 | McKinney et al. | 5/654 |
| 7,984,952 | B2 * | 7/2011 | Begin et al. | 297/452.56 |
| 8,449,032 | B2 * | 5/2013 | Serhan | 297/284.11 |
| 8,590,978 | B2 * | 11/2013 | Jaranson et al. | 297/452.15 |

(Continued)

OTHER PUBLICATIONS

International Search Report dated Feb. 21, 2012 in International application No. PCT/US2011/050986 filed Sep. 9, 2011.

(Continued)

*Primary Examiner* — Joseph Rocca
*Assistant Examiner* — Gabriela C Craciun
(74) *Attorney, Agent, or Firm* — Thedford I Hitaffer; Hitaffer & Hitaffer, PLLC

(57) ABSTRACT

A suspension seat comprises a structural layer and a stretchable top layer above the structural layer. The structural layer comprises a cut-out. The perimeter of the cut-out is defined by a plurality of discrete members. The discrete members allow the buttocks (i.e., the tissue surrounding the ischial sacrococcygeal aspects of the skeleton) of a wheelchair user to enter into the cut-out with gradual pressure minimizing high pressure concentrations at the edges of the cut-out. The stretchable top layer bears load via tension as the wheelchair user buttocks deflects into the cut-out.

26 Claims, 7 Drawing Sheets

(56) References Cited

U.S. PATENT DOCUMENTS

| | | | | |
|---|---|---|---|---|
| 2003/0030251 | A1* | 2/2003 | Malassigne et al. | 280/648 |
| 2005/0067861 | A1* | 3/2005 | Avihod | 297/42 |
| 2010/0140898 | A1* | 6/2010 | Purdue | 280/250.1 |
| 2011/0258778 | A1* | 10/2011 | Brykalski et al. | 5/421 |

OTHER PUBLICATIONS

Written Opinion of the International Searching Authority Feb. 21, 2012 in International application No. PCT/US2011/050986 filed Sep. 9, 2011.

Notification Concerning Transmittal of International Preliminary Report on Patentability, The International Bureau of WIPO, Mar. 21, 2013, International Application No. PCT/US2011/050986.

International Preliminary Report on Patentability, The International Bureau of WIPO, Mar. 21, 2013, International Application No. PCT/US2011/050986.

Written Opinion of the International Searching Authority, The International Bureau of WIPO, Feb. 21, 2012, International Application No. PCT/US2011/050986.

* cited by examiner

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 23 | 11 | 19 | 14 | 0 | 0 | 0 | 2 | 15 | 12 | 18 | 16 | 0 |
| 0 | 0 | 0 | 0 | 17 | 15 | 19 | 0 | 0 | 0 | 10 | 26 | 17 | 35 | 29 | 0 |
| 0 | 0 | 0 | 25 | 24 | 23 | 15 | 0 | 0 | 0 | 0 | 36 | 45 | 25 | 45 | 0 |
| 0 | 0 | 0 | 25 | 17 | 20 | 21 | 0 | 0 | 0 | 0 | 22 | 36 | 47 | 15 | 0 |
| 0 | 0 | 3 | 21 | 11 | 10 | 14 | 0 | 0 | 0 | 0 | 22 | 33 | 36 | 20 | 0 |
| 0 | 0 | 17 | 28 | 23 | 39 | 35 | 18 | 0 | 0 | 3 | 15 | 14 | 34 | 22 | 3 |
| 0 | 0 | 14 | 33 | 27 | 35 | 34 | 12 | 0 | 0 | 16 | 19 | 15 | 34 | 30 | 14 |
| 0 | 0 | 19 | 29 | 29 | 78 | 34 | 15 | 0 | 0 | 28 | 34 | 29 | 23 | 59 | 4 |
| 0 | 0 | 5 | 30 | 26 | 49 | 100 | 21 | 0 | 6 | 55 | 78 | 79 | 51 | 47 | 0 |
| 0 | 0 | 38 | 36 | 45 | 78 | 141 | 62 | 37 | 44 | 67 | 89 | 64 | 34 | 24 | 3 |
| 0 | 0 | 18 | 32 | 54 | 137 | 90 | 145 | 68 | 94 | 135 | 78 | 50 | 49 | 22 | 0 |
| 0 | 0 | 0 | 8 | 39 | 95 | 78 | 168 | 36 | 66 | 134 | 68 | 48 | 21 | 29 | 0 |
| 0 | 0 | 1 | 24 | 40 | 71 | 97 | 132 | 13 | 70 | 134 | 41 | 43 | 32 | 10 | 0 |
| 0 | 0 | 0 | 18 | 39 | 51 | 55 | 62 | 66 | 43 | 74 | 47 | 47 | 24 | 0 | 0 |
| 0 | 0 | 0 | 0 | 20 | 4 | 11 | 10 | 5 | 0 | 10 | 13 | 0 | 0 | 0 | 0 |

FIG. 2

| | | | | | | | | | | | | | | | |
|---|---|---|---|---|---|---|---|---|---|---|---|---|---|---|---|
| 0 | 0 | 0 | 9 | 31 | 35 | 17 | 0 | 0 | 0 | 0 | 26 | 47 | 21 | 10 | 0 |
| 0 | 0 | 0 | 20 | 36 | 33 | 13 | 0 | 0 | 0 | 0 | 11 | 25 | 27 | 14 | 0 |
| 0 | 0 | 0 | 28 | 43 | 47 | 20 | 0 | 0 | 0 | 0 | 19 | 29 | 36 | 22 | 0 |
| 0 | 0 | 9 | 26 | 47 | 47 | 31 | 0 | 0 | 0 | 0 | 44 | 59 | 36 | 37 | 0 |
| 0 | 0 | 0 | 23 | 39 | 40 | 41 | 0 | 0 | 0 | 0 | 22 | 30 | 34 | 17 | 0 |
| 0 | 0 | 7 | 14 | 34 | 39 | 60 | 0 | 0 | 0 | 0 | 18 | 16 | 28 | 31 | 0 |
| 0 | 0 | 37 | 21 | 43 | 59 | 56 | 19 | 0 | 0 | 22 | 26 | 28 | 17 | 29 | 9 |
| 0 | 0 | 15 | 27 | 24 | 11 | 9 | 8 | 0 | 0 | 25 | 18 | 35 | 39 | 44 | 24 |
| 0 | 0 | 8 | 11 | 47 | 63 | 29 | 30 | 0 | 11 | 34 | 32 | 30 | 33 | 51 | 9 |
| 0 | 0 | 29 | 38 | 19 | 34 | 65 | 29 | 0 | 18 | 70 | 34 | 41 | 42 | 38 | 22 |
| 0 | 0 | 43 | 45 | 73 | 32 | 77 | 32 | 0 | 0 | 52 | 61 | 50 | 52 | 31 | 11 |
| 0 | 0 | 40 | 37 | 64 | 63 | 58 | 64 | 20 | 20 | 58 | 35 | 46 | 42 | 14 | 0 |
| 0 | 0 | 0 | 8 | 40 | 39 | 19 | 64 | 3 | 20 | 58 | 22 | 13 | 5 | 0 | 0 |
| 0 | 0 | 0 | 0 | 4 | 71 | 97 | 132 | 0 | 5 | 51 | 8 | 1 | 0 | 0 | 0 |
| 0 | 0 | 0 | 0 | 0 | 35 | 23 | 67 | 24 | 7 | 54 | 26 | 0 | 0 | 0 | 0 |
| 0 | 0 | 0 | 0 | 9 | 19 | 40 | 75 | 101 | 24 | 60 | 44 | 19 | 0 | 0 | 0 |

FIG. 10

SUSPENSION SEAT FOR USE ON WHEELCHAIR

CROSS-REFERENCE TO RELATED APPLICATIONS

This application, filed under 35 USC 371, is a United States National Stage Application of International Application No. PCT/US2011/050986, filed Sep. 9, 2011, which claims priority to U.S. Provisional Application No. 61/381,607, filed on Sep. 10, 2010, the disclosures of which are incorporated herein by reference.

STATEMENT REGARDING FEDERALLY SPONSORED RESEARCH OR DEVELOPMENT

This invention was made with government support under H133E030035 and H133E080003 awarded by the Department of Education. The government has certain rights in the invention.

BACKGROUND OF THE INVENTION

This invention relates in general to mobility vehicles, and more particularly to wheelchair seating. The most basic wheelchair seating surface is the sling. Many wheelchair users sit directly on a sling, while others sit on a cushion atop a sling. Sitting directly on a sling is not advisable, as it does not provide for an adequate distribution of the user's body weight, and it encourages postural asymmetries, such as pelvic obliquity and internal hip rotation, as illustrated in FIG. 1. Many wheelchair users also slide forward while sitting directly on the sling upholstery, causing increased pressure in the sacral region and placing them at risk of sliding out of the wheelchair. Additionally, users sitting directly on the sling often experience high pressure on the areas of bony prominence, such as the ischial tuberosities and coccyx. High pressure in these areas increases the risk of skin wounds, such as pressure ulcers. In FIG. 2, there is illustrated a measurement of interface pressures as a wheelchair user sits directly on a conventional sling.

One reason why wheelchair users sit directly on the sling is because of their need to reach the ground and propel the wheelchair with their feet, as illustrated in FIG. 3. Such users cannot sit on wheelchair cushions that increase sitting height because they could no longer reach the ground adequately to propel the wheelchair with their feet.

SUMMARY OF THE INVENTION

The present invention relates to a suspension seat that addresses the aforementioned limitations of the sling seat while providing a low sitting height. The suspension seat comprises a structural layer and a stretchable top layer above the structural layer. The structural layer comprises an ischial sacrococcygeal cut-out. The perimeter of the cut-out is defined by a plurality of discrete members. The discrete members allow the tissue surrounding the ischial & sacrococcygeal aspects of the pelvis and spine to enter into the cut-out and be supported without high pressure concentrations at the edges of the cut-out. The stretchable top layer bears load via tension as the buttocks tissue enters into the cut-out and deflects the plurality of members at its periphery.

Various advantages of this invention will become apparent to those skilled in the art from the following detailed description of the preferred embodiment, when read in light of the accompanying drawings.

BRIEF DESCRIPTION OF THE DRAWINGS

FIG. 2 is a measurement of interface pressures of a wheelchair user's body weight as the wheelchair user sits directly on a conventional sling.

FIG. 10 is a measurement of interface pressures of a wheelchair user's body weight as the wheelchair user sits directly on the suspension seat.

DETAILED DESCRIPTION OF THE PREFERRED EMBODIMENT

Figure 1:
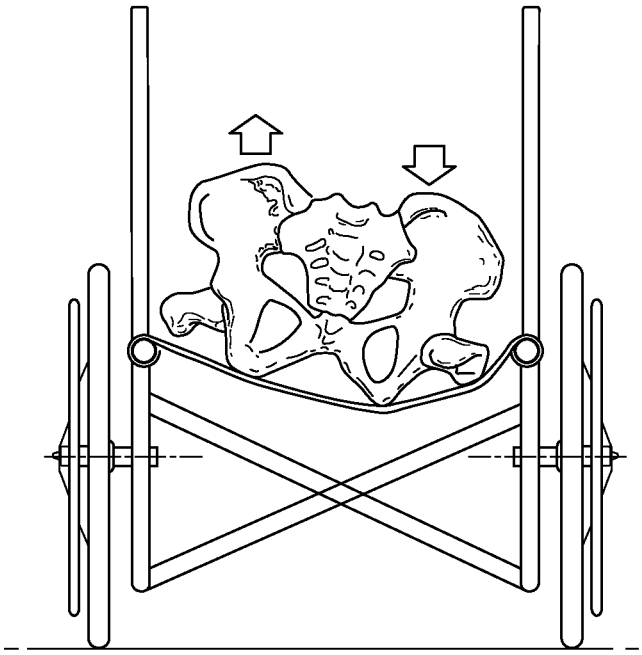
FIG. 1 is a front elevational view of a conventional wheelchair with a sling providing inadequate distribution of a wheelchair user's body.
Figure 3:
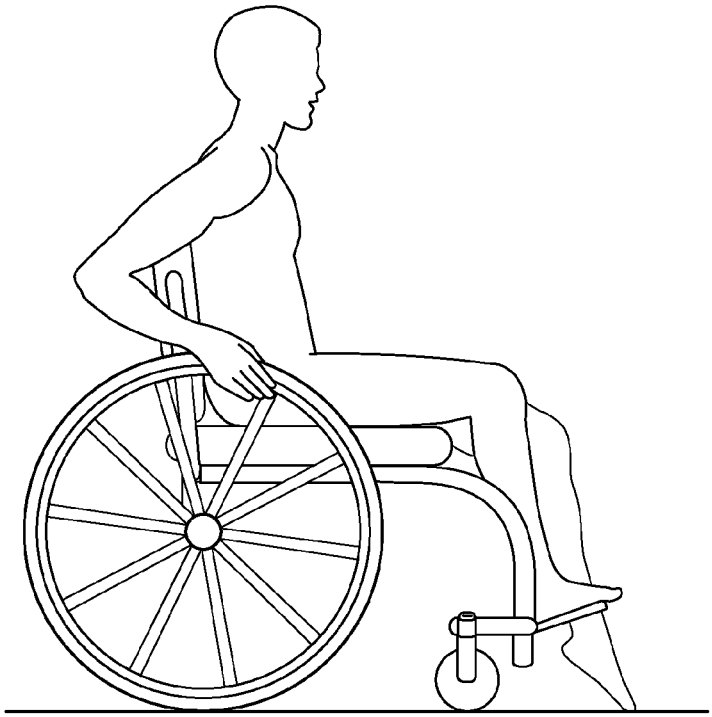
FIG. 3 is a side elevational view of a conventional wheelchair with a conventional cushion raising the sitting height so that the supporting surface is difficult to reach by a user propelling the wheelchair by foot.
Figure 4:
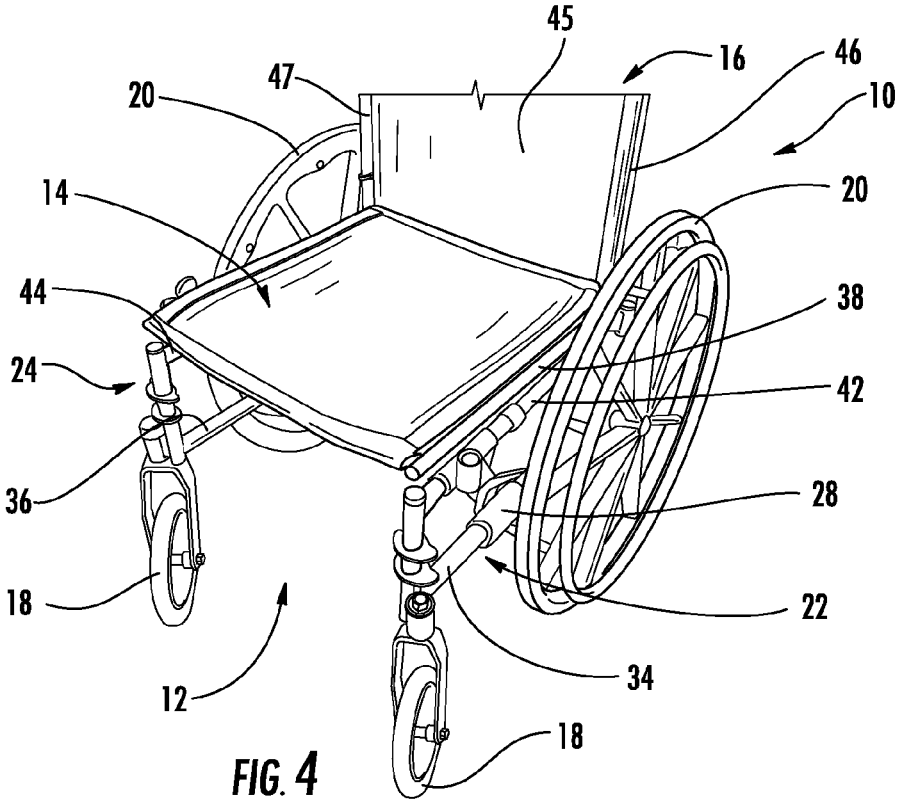
FIG. 4 is a front perspective view of a wheelchair with a suspension seat that results in a lower sitting height.

Referring now to the drawings, there is illustrated in FIG. 4 a manually driven wheelchair, generally indicated at 10. The illustrated wheelchair 10 includes a frame 12 supporting a suspension seat 14 and a seatback 16, which support a wheelchair user when sitting on the wheelchair 10. The frame 12 is supported for movement along a supporting surface (e.g., the floor or the ground) by front wheels 18 and rear wheels 20, the axle of which may be adjusted in height and orientation in relation to the frame 12. The front wheels 18 are castered wheels, which are capable of swiveling to permit the wheelchair 10 to be directed as desired by the wheelchair user. The rear wheels 20 are driven wheels, which have a handrail that may be gripped by the wheelchair user to drive the rear wheels 20 and thus propel the wheelchair 10. Although the illustrated wheelchair 10 is a manually driven folding wheelchair, the wheelchair may be in the form of a power driven wheelchair and a non-folding wheelchair. Although the suspension seat 14 is particularly suitable for use on wheelchairs, it could be used to meet a host of other seating requirements, including but not limited to seating for automobiles, trucks, buses, airplanes, office chairs, and the like. In addition, the wheelchair 10 may be a specialty wheelchair, which can be ordered to the user's specification, including a wheelchair with a low seat height.

The illustrated frame 12 includes opposing side frames 22, 24 and a folding mechanism, as is known in the art, which includes a pair of cross tubes (only one shown) that are pivotally connected to each other at a pivot point (not shown), which may be centrally located. Lower ends of the cross tubes 28 are pivotally connected to lower side frame tubes 34, 36. Upper ends of the cross tubes 28 terminate in opposing seat tubes 38, which support the suspension seat 14, which spans between the side frames 22, 24. When the wheelchair 10 is unfolded, the seat tubes 38 nest in relation to upper side frame tubes 42, 44. This may limit pivotal movement of the cross tubes 28 and hold the frame 12 in an unfolded position. When the wheelchair 10 is folded, the seat tubes 38 rise in relation to the upper side frame tubes 42, 44 and the side frames 22, 24 are urged inwardly towards each other.

It is instructive to note that the seatback 16 may be an upholstery seat back 45 spanning between opposing seat back canes 46, 47, or other suitable structure, to support the back of the wheelchair user when sitting on the wheelchair 10. The opposing seat back canes 46 may extend upward from the side frames 22, 24 when the wheelchair 10 is unfolded, and may pivot downward in relation to the side frames 22, 24 when the wheelchair 10 is folded.

Figure 5:
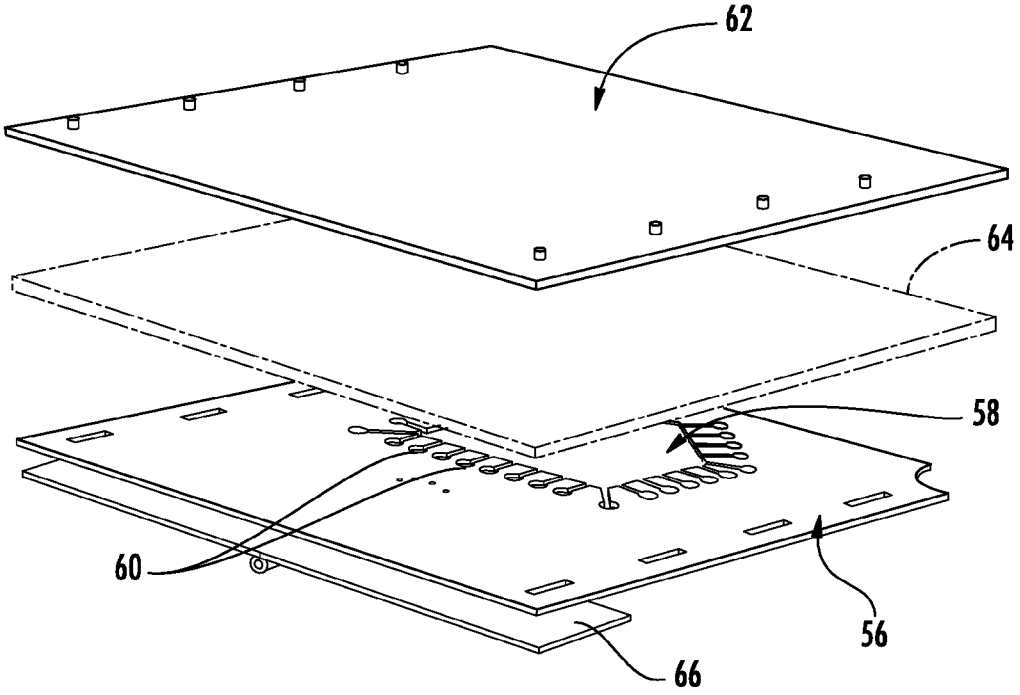
FIG. 5 is a perspective view of a multi-layer suspension seat.
Figure 6:
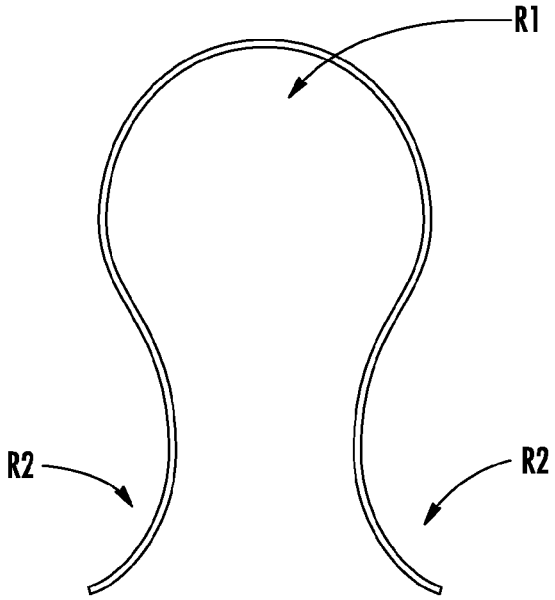
FIG. 6 is a diagrammatic front elevational view of the suspension seat folding along radiused curves.

As illustrated in FIG. 5, the suspension seat 14 may be comprised of a structural layer 56, which has some structural rigidity. For example, the structural layer 56 is firm, yet bendable, but is substantially non-stretchable and substantially non-compressible so that the structural layer 56 does not tightly fold, but instead folds along a relatively wide or open radiused curves R1, R2, as shown in FIG. 6. The structural layer 56 does not substantially sag (e.g., does not substantially sink or bend downward by weight or pressure of the user, especially in the center of the suspended seat 14) when supporting the wheelchair user.

The structural layer 56 may be in the form of a relatively thin flexible polymer layer, which may be formed of polyethylene terephthalate (i.e., PET, PETE, PETG), which is a plastic resin of the polyester family, or high-density polyethylene (HDPE), or polypropylene, or some other suitable material that can assume a curved profile when the wheelchair 10 is folded. Alternatively, the suspension seat 14 may flip up when the wheelchair 10 is folded or may incorporate a hinge mechanism to permit folding. It is instructive to note that some portion or the entire structural layer 56 may not be bendable, in which case the suspension seat 14 may flip up, and not bend. This would be particularly suitable for use, for example, with other types of wheelchairs, such as a bariatric wheelchair. Further, the structural layer 56 may be attached to the wheelchair frame 12 so that the suspension seat 14 may be removed as opposed to folding or being flipped up. Additionally, the structural layer 56 may be attached to frame 12 with various types of components that suspend the suspension seat 14 at some elevation below the seat tubes 34, 36 and/or upper side frame tube 42, 44. This may be done with spacers, hanger, hooks, and the like, which are well known in art. Such an arrangement would be well suited for use as a drop seat.

The structural layer 56 has a cut-out 58. The cut-out 58 is in the area of the wheelchair user's buttocks (e.g., the tissue surrounding the bony pelvis of the user). The cut-out 58 may be sized and positioned according to general anthropometric and postural data. That is to say, the cut-out 58 may be sized and positioned according to anthropometry of the pelvis, including but not limited to ischial spacing, bitrochanteric breadth, and anteroposterior location of the pelvis in relation to the rear edge of the seat. In other words, the cut-out 58 may be positioned in an anteroposterior location based upon anthropometry of seated humans. Methods of acquiring anthropometric and postural data are well known in the art.

Figure 7:
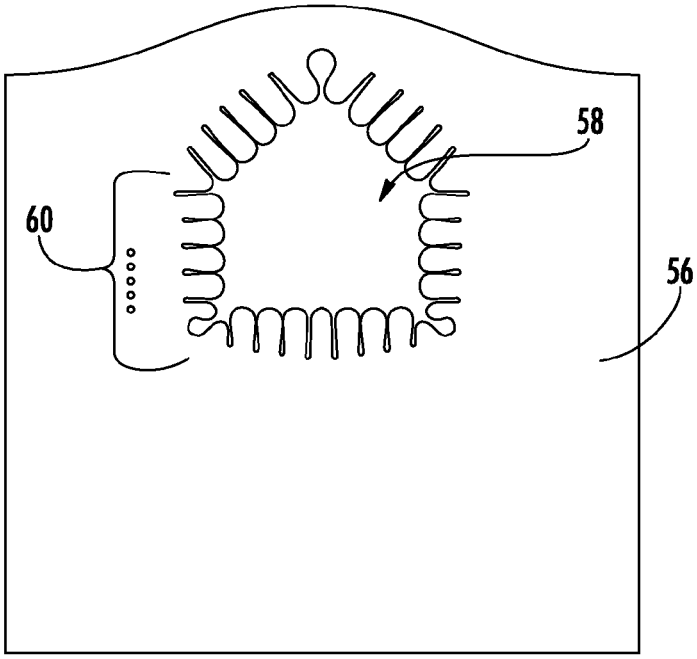
FIG. 7 is a top plan view of the perimeter of a cut-out in a structural layer.

Although the cut-out 58 may be any suitable shape, the illustrated cut-out 58 is generally in the form of an irregular pentagon shaped cut-out, such as in the shape of a home plate, as used in the game of baseball. The perimeter of the cut-out 58 is defined by a plurality of discrete members 60, such as fingers, tabs, or the like, as illustrated in FIG. 7. The discrete members 60 may allow the buttocks to enter into the cut-out 58 with a gradual transition to reduce pressure (i.e., to reduce high pressure concentrations at the edges of the cut-out 58) and reduce the risk of problems typically associated with coccyx cushions, including but not limited to ring, donut or doughnut cushions, as are known in the art. It should be appreciated that the cut-out 58 redistributes pressure without the aid of a cushion and thus, without raising the height of the suspension seat 14 in relation to the supporting surface.

It is instructive to note that the cut-out 58 supports the buttocks (i.e., the tissues surrounding the ischial tuberosities and the coccyx) by use of tension, not by compression or immersion, like conventional seats, which use compressible and/or immersible material. The shape and location of the cut-out provides added sitting stability by enveloping the buttocks and counteracting the forward sliding tendency, thereby reducing the likelihood of sliding forward in the wheelchair and reducing the likelihood of falling from the wheelchair.

Above the structural layer 56 is a stretchable top layer 62. The top layer 62 provides load bearing via tension, as the buttocks enters into the cut-out 58. The top layer 62 may be formed of any suitable material, including rubber, neoprene, polyester, nylon, spandex, elastane, spacer fabric, or a combination thereof that provides two-way stretch or a four-way stretch. For example, the top layer material may be in the form of a polyurethane film cast coated or laminated on nylon, polyester, spandex, or similar materials. The top layer 62 may offer extensibility and air exchange for wicking purposes. Alternatively, the top layer 62 may be fluid resistant or fluid proof so that the suspension seat 14 may be sprayed with a cleaner and wiped clean and dried.

The combination of the cut-out 58 and stretchable top layer 62 provides a supportive force that minimizes or eliminates the tendency of the pelvis to slide forward in the suspension seat 14. Moreover, the combination of the cut-out 58 and stretchable top layer 62 allows the inferior aspect of the buttocks to be at or below the height of the wheelchair's horizontal seat member (i.e., the structural layer 56). This permits the wheelchair user to sit lower in the seat, thereby facilitating foot propulsion and transfers out of the wheelchair, compared to cushions that rest atop seat upholstery.

Figure 8:
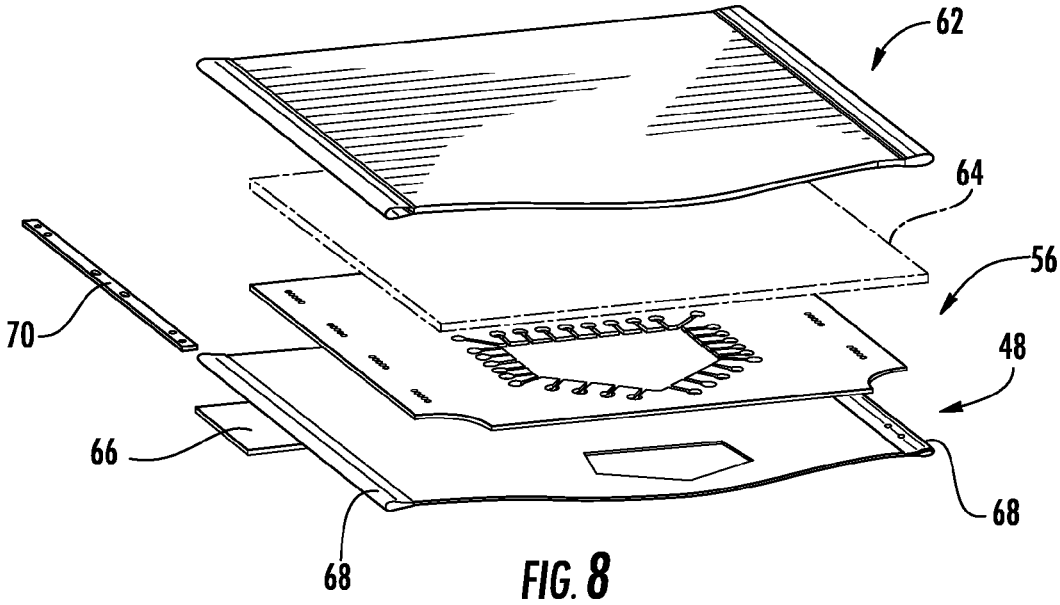
FIG. 8 is a perspective view of an alternative multi-layer suspension seat.

An optional bottom layer 48 may be provided beneath the structural layer 56, as shown in FIG. 8. The bottom layer 48 may be in the form of a flexible yet substantially non-stretchable material, which may provide support that is substantially non-yielding to weight of the wheelchair user, yet fold when the wheelchair 10 is folded. That is to say, the bottom layer 48 may be formed of a material that does not sag under the load of the user but instead is stiff or unyielding. The bottom layer 48, for example, may be in the form of woven fabric, such as a nylon woven material, which may be breathable, and which may permit drainage. The bottom layer 48 should be non-stretch material, which when pulled taught between the seat tubes 42, 44, when the wheelchair 10 is unfolded, does not sag downward under the load of the user, which occurs with a conventional sling. It should be appreciated that the structural layer 56 may work in concert with the bottom layer 48 to prevent sagging. Further, the bottom layer 48 may be structurally rigid in one or more locations (e.g., with rigid inserts) to prevent it from displacing downward when sat upon, but permit the suspension seat 14 to be folded along radiused curves R1, R2. Alternatively, the suspension seat 14 may flip up when the wheelchair 10 is folded.

Figure 9:
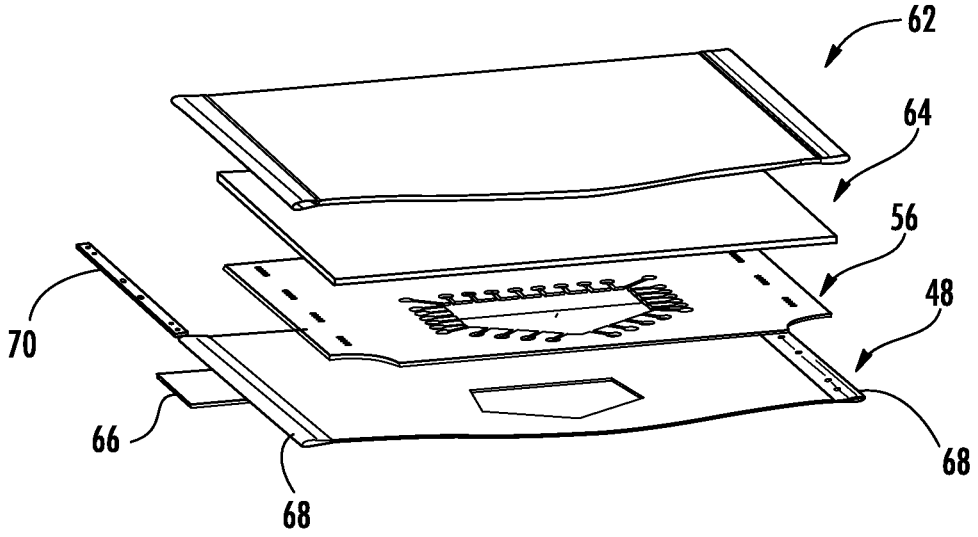
FIG. 9 is a perspective view of another multi-layer suspension seat.

An optional resilient layer 64 may be provided between the top layer 62 and the structural layer 56, as shown in FIG. 9. The resilient layer 64 may be in the form of reticulated foam (i.e., very porous, low density solid foam), which promotes drainage and reduces bacterial growth and odor. The resilient layer 64 may be scored, for example, with an X-shaped score, over the cut-out 58 so that the resilient layer 64 does not provide additional or excess tension in the area above the cut-out 58.

It should be understood that the stretchable top layer 62 may function as a tension member to support the buttocks (i.e., the tissues in the ischial-sacral areas), and the resilient layer 64 may function as a compression member to support the thighs and ischial sacrococcygeal. That is to say, the resilient layer 64 may compress to support the thighs and lateral aspects of the buttocks, rather than support the tissues surrounding the ischial-sacral skeleton.

An optional anterior bar 66 (e.g., rigid hinged element) may be provided for supporting the thighs of the wheelchair user. The anterior bar 66 may be situated beneath the suspension seat 14, or integrated with the suspension seat 14, such as within a pocket (not shown) in a layer, such as the bottom layer 48. The anterior bar 66 may include one or more one-way hinges. The one-way hinge may fold and unfold with the wheelchair 10, and may have limited travel when unfolded so as to unfold (e.g., into a substantially planar member) to provide subjacent support for the thighs. The anterior bar 66 may be formed of any material suitable to provide adequate support for the user, including but not limited to thermoplastic, such as acrylonitrile butadiene styrene (ABS). Although other physical dimensions may be suitable, depending on the wheelchair 10 and the wheelchair user, the anterior bar 66 having a depth (i.e., extending in a front to rear direction in relation to the wheelchair 10) of about 2.5 inches (6.35 cm) may provide suitable support for the thighs. If the anterior bar 66 is present, the suspension seat 14 (i.e., the structural layer 56) may fold along radiused curves R1, R2 but instead may flip up, as mentioned above.

Although not necessary, the layers 48, 56, 62 and 64 may be secured to one another, such as by being sewn and/or glued and/or sealed together, providing that the stretchable top layer 62 is not secured to any other member in the area within the cut-out 58 (i.e., the top layer 62 should be free to stretch into the cut-out 58 and around the buttocks.

It should be appreciated that the bottom layer 48 may form a sub-structure for supporting the wheelchair user substantially level to provide sitting stability without encouraging the wheelchair user to slide forward on the seat, especially a user who propels the wheelchair 10 by foot. It should be understood that the bottom layer 48 may be omitted and the structural layer 56 may provide sub-structure, provided that the structural layer 56 is sufficiently stiff and thick to resist folding.

The suspension seat 14 may be supported by the seat tubes 38 in any suitable manner. For example the suspension seat 14 may have lateral edges with sleeves for receiving attachment rods, which may be inserted into the seat tubes 38 for holding the suspension seat 14 in relation to the side frame 22, 24, as is known in the art. As shown in FIGS. 8 and 9, the bottom layer 48 has lateral edges, which may have sleeves 68 for receiving attachment rods 70, which may be inserted into the seat tubes 38 for holding the suspension seat 14 in relation to the side frame 22, 24, as it known in the art. Alternatively, the suspension seat 14 may be supported by hooks, or other structure (not shown), which positions the suspension seat 14 flush with or below the seat tubes 38, the latter forming a drop seat. A drop seat would allow the user to reduce seat-to-floor height even further.

It should be appreciated that the suspension seat 14 may bend when the wheelchair 10 folds, flip up when the wheelchair 10 folds, simply be removed when the wheelchair 10 folds.

It is instructive to note that the suspension seat 14 may be attached directly to the wheelchair frame 12, in the place of a conventional sling seat. Moreover, the top layer 62 provides load bearing via tension, as compared to the compression member (i.e., foam, air, etc.) used in conventional wheelchair seating systems, to stabilize the buttocks and effectively redistribute the wheelchair user's body weight, as illustrated in FIG. 10. As a consequence, the suspension seat 14 provides a low-profile pressure management system that overcomes deficiencies in sling seats.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A suspension seat, comprising:

a structural layer that is substantially stiff, substantially non-stretchable, and substantially non-compressible, so that the structural layer does not substantially sag when supporting a user, the structural layer comprising a cut-out that allows the buttocks of the user to enter into the cut-out with gradual pressure, thus minimizing high pressure concentrations at edges of the cut-out;

a stretchable top layer above the structural layer for bearing load via tension as the user's buttocks enters into the cut-out and deflects into the cut-out, wherein the cut-out and top layer allow an inferior aspect of the buttocks to be at or below the height of the structural layer to permit the user to sit lower in the seat, thereby facilitating sitting stability, and a flexible bottom layer beneath the structural layer, the flexible bottom layer being substantially non-stretchable to provide support for the structural layer, the stretchable top layer and the user, when sitting on the suspension seat.

2. The suspension seat of claim 1, wherein the flexible bottom layer is in the form of woven fabric, which is breathable, and which permits drainage.

3. The suspension seat of claim 1, wherein the flexible bottom layer has lateral edges with sleeves for receiving attachment rods, which are attachable to seat tubes of a wheelchair for holding the bottom layer in relation to side frames of the wheelchair.

4. The suspension seat of claim 1, wherein the structural layer is foldable along radiused curves.

5. The suspension seat of claim 1, wherein the structural layer is in the form of a thin polymer layer.

6. The suspension seat of claim 5, wherein the structural layer is formed from a material selected from a group of materials consisting essentially of polyethylene terephthalate, high-density polyethylene, and polypropylene.

7. The suspension seat of claim 1, wherein the structural layer is substantially rigid.

8. The suspension seat of claim 1, wherein the structural layer is attachable to and detachable from a wheelchair.

9. The suspension seat of claim 8, wherein the structural layer is not bendable or foldable and is adapted to flip up in relation to the wheelchair or detach from the wheelchair.

10. The suspension seat of claim 1, wherein the cut-out is sized and positioned according to anthropometry of the pelvis selected from a group consisting essentially of ischial spacing, bitrochanteric breadth, and anteroposterior location of the pelvis in relation to the rear edge of the seat.

11. The suspension seat of claim 1, wherein the cut-out is generally in the form of an irregular pentagon shaped cut-out.

12. The suspension seat of claim 11, wherein the cut-out has a perimeter that is defined by a plurality of discrete members to allow the buttocks of the user to enter into the cut-out with gradual pressure to reduce high pressure concentrations at edges of the cut-out.

13. The suspension seat of claim 1, wherein the top layer is formed from a material that substantially stretches in any direction.

14. The suspension seat of claim 1, wherein the top layer is formed from a material selected from a group of materials consisting essentially of rubber, neoprene, and a combination thereof.

15. The suspension seat of claim 1, wherein the top layer offers air exchange for wicking purposes.

16. The suspension seat of claim 1, wherein the top layer is resistant to fluid.

17. The suspension seat of claim 1, wherein the top layer is fluid proof or easy cleaning.

18. The suspension seat of claim 1, further comprising: a resilient layer between the top layer and the structural layer, wherein the top layer is a tension member to support the tissues in the sacral-ischial areas, and the resilient layer is a compression member to support the thighs and buttocks.

19. The suspension seat of claim 1, wherein the resilient layer is in the form of reticulated foam that is suitable to promote drainage and reduce bacterial growth and odor.

20. The suspension seat of claim 1, wherein the layers are secured to one another by at least one of sewing, gluing or sealing the layers together so that the top layer is not secured to the structural layer around or within the cutout so that the top layer is free to stretch into the cutout and around the buttocks.

21. The suspension seat of claim 1, further comprising: an anterior bar for supporting the thighs of the user and further off-loading weight from the buttocks.

22. The suspension seat of claim 21, wherein the anterior bar is situated beneath the suspension seat.

23. The suspension seat of claim 21, wherein the anterior bar is integrated with the suspension seat, within a pocket in a layer.

24. The suspension seat of claim 21, wherein the anterior bar includes one or more hinges, which fold and unfold.

25. The suspension seat of claim 21, wherein the anterior bar is formed of plastic.

26. The suspension seat of claim 1, in combination with a folding manually driven wheelchair, comprising:

a frame supporting the suspension seat;

a seatback supported by the frame, the seatback supporting the wheelchair user, when sitting on the wheelchair;

a plurality of wheels supporting the frame for movement along a supporting surface, the plurality of wheels including at least one front caster wheel and a pair of rear driven wheels for propelling the wheelchair.

* * * * *